US007488387B2

(12) United States Patent
Kuo

(10) Patent No.: US 7,488,387 B2
(45) Date of Patent: Feb. 10, 2009

(54) APPARATUS AND METHOD FOR THREE-DIMENSIONALLY PLANTING PILE

(76) Inventor: Tien Sung Kuo, No. 62, Lane 2375, Ching-Kuo Rd., Ta-Chia City, Taichung Hsien (TW)

( * ) Notice: Subject to any disclaimer, the term of this patent is extended or adjusted under 35 U.S.C. 154(b) by 436 days.

(21) Appl. No.: 11/263,962

(22) Filed: Nov. 2, 2005

(65) Prior Publication Data

US 2007/0095550 A1 May 3, 2007

(51) Int. Cl.
*B05B 5/025* (2006.01)

(52) U.S. Cl. ..... 118/629; 239/698; 239/708

(58) Field of Classification Search ..... 118/620–633, 118/306, 317; 427/457–463; 239/692, 697–708
See application file for complete search history.

(56) References Cited

U.S. PATENT DOCUMENTS 3,347,469 A * 10/1967 Ross et al. ..... 239/424
3,735,925 A * 5/1973 Benedek et al. ..... 239/704
4,011,991 A * 3/1977 Masuda ..... 239/708
4,246,294 A * 1/1981 Jordan ..... 427/462

* cited by examiner

*Primary Examiner*—Yewebdar T Tadesse
(74) *Attorney, Agent, or Firm*—Muncy, Geissler, Olds & Lowe, PLLC

(57) ABSTRACT

In an apparatus including a shooting device, a planting device, a drive source for feeding pressurized air to the shooting device, a pile feeding container in communication with the shooting device, and a charge supply including positive and negative charge supply terminals, a method for three-dimensionally planting pile includes coating adhesive on one or more surfaces of a three-dimensional member; electrically connecting the positive charge supply terminal to the planting device for forming a positive electric field thereon; electrically connecting the negative charge supply terminal to the member to be planted for forming a negative electric field thereon with an electrostatic field from the planting device to the member being established; activating the shooting device to project pile through the planting device toward the one or more surfaces of the member as driven by the electrostatic field; and adhering the pile to the one or more surfaces of the member.

6 Claims, 15 Drawing Sheets

APPARATUS AND METHOD FOR THREE-DIMENSIONALLY PLANTING PILE

BACKGROUND OF THE INVENTION

1. Field of Invention

The present invention relates to pile planting and more particularly to apparatus and method for three-dimensionally planting pile with improved characteristics.

2. Description of Related Art

Conventional pile planting methods are either downward pile planting methods or upward pile planting methods. Either method involves projecting pile toward a flat surface coated with adhesive by utilizing the principle of electrostatic field and free falling so as to plant piles thereon. Such methods are disclosed in a number of Taiwanese Utility Model Patents. The characteristics of the prior patents are that an electrostatic field is disposed in parallel with and above a flat surface and quality of planted pile on the surface is determined by the strength of the electrostatic field. However, pile planting on each surface of a hollow three-dimensional object or non-flat surface is not possible by carrying out the prior patents. This is also true for a surface disposed perpendicular to the electrostatic field, inside and outside surfaces of a cylindrical member or inner and outer walls of a recessed or tank member. Thus, the need for improvement still exists.

SUMMARY OF THE INVENTION

It is therefore an object of the present invention to provide in an apparatus including a shooting device, a planting device, a drive source for feeding pressurized air to the shooting device, a pile feeding container in pile communication with the shooting device, and a charge supply including a positive charge supply terminal and a negative charge supply terminal, a method for three-dimensionally planting pile comprising coating or spraying adhesive on one or more surfaces of a three-dimensional member; electrically connecting the positive charge supply terminal to the planting device for forming a positive electric field thereon; electrically connecting the negative charge supply terminal to the member for forming a negative electric field thereon with an electrostatic field from the planting device to the member being established; activating the shooting device to project pile through the planting device toward the one or more surfaces of the member as driven by the electrostatic field; and adhering the pile to the one or more surfaces of the member.

It is another object of the present invention to provide an apparatus for three-dimensionally planting pile comprising a shooting device; a planting device mounted at the shooting device; a pile feeding container in pile communication with the shooting device through a flexible pipe; a drive source for feeding pressurized air to the shooting device; and a charge supply for supplying positive charges to the planting device and negative charges to a member to be planted with pile so as to establish an electrostatic field from the planting device to the member.

It is yet another object of the present invention to provide in an apparatus including a shooting device having a forward elongate nozzle, a drive source for feeding pressurized air to the shooting device, a pile feeding container in pile communication with the shooting device, and a charge supply including a positive charge supply terminal and a negative charge supply terminal, a method for three-dimensionally planting pile comprising coating adhesive on an inner surface of an elongate hollow member; electrically connecting the positive charge supply terminal to the nozzle for forming a positive electric field thereon; electrically connecting the negative charge supply terminal to the member to be planted for forming a negative electric field thereon with an electrostatic field from the nozzle to the member being established; activating the shooting device and moving the nozzle into the member and leaving same alternately to project pile through the nozzle toward the inner surface of the member as driven by the electrostatic field; and adhering the pile to the one or more surfaces of the member (FIG. 6).

It is a further object of the present invention to provide an apparatus for three-dimensionally planting pile comprising a shooting device; a planting device mounted at the shooting device; a pile feeding container in pile communication with the shooting device through a flexible pipe; a drive source for feeding pressurized air to the shooting device; and a charge supply for supplying positive charges to the planting device and negative charges to an elongate hollow member to be planted with pile so as to establish an electrostatic field from the planting device to inside of the member.

It is a yet further object of the present invention to provide in an apparatus including a shooting device having a forward nozzle, a drive source for feeding pressurized air to the shooting device, a pile feeding container in pile communication with the shooting device, a metal mesh mounted at the nozzle, and a charge supply including a positive charge supply terminal and a negative charge supply terminal, a method for three-dimensionally planting pile comprising coating adhesive on a surface of a member having a large surface area; electrically connecting the positive charge supply terminal to the mesh for forming a positive electric field thereon; electrically connecting the negative charge supply terminal to the member for forming a negative electric field thereon with an electrostatic field from the mesh to the member being established; activating the shooting device to project pile through the nozzle toward the surface of the member as driven by the electrostatic field; and adhering the pile to the surface of the member.

It is a yet further object of the present invention to provide an apparatus for three-dimensionally planting pile comprising a shooting device including a forward nozzle; a metal mesh assembly; a pile feeding container in pile communication with the shooting device through a flexible pipe; a drive source for feeding pressurized air to the shooting device; and a charge supply for supplying positive charges to the mesh assembly and negative charges to a member to be planted with pile so as to establish an electrostatic field from the mesh assembly to the member.

In one aspect of the present invention, the planting device is a mesh having a plurality of rectangular or square openings, a plurality of parallel longitudinal openings, a plurality of parallel transverse openings, a plurality of parallel first oblique openings, a plurality of parallel second oblique openings perpendicular to that the first oblique openings, a plurality of openings formed by intersections of a first plurality of parallel oblique lines and a second plurality of parallel oblique lines perpendicular to the first plurality of parallel lines, a plurality of circular openings, or a plurality of parallel hexagonal openings.

In another aspect of the present invention, the planting device comprises a metal mesh assembly or a ring member, and the metal mesh assembly being a flat surface, a curved surface and the member to be planted with pile comprising except inside and outside surfaces of a cylindrical member or inner and outer walls of a recessed or tank member, further comprising a large surface area implemented as a wall, a ceiling, or a floor.

In yet another aspect of the present invention, the mesh assembly comprises a lower platform having a plurality of wheels and a brake provided at each of the wheels, and top and bottom U-shaped insulative members each having both ends engaged with the member.

In a further aspect of the present invention, the planting device is shaped as an L-shaped cylinder and comprises an L-shaped member having an open end secured to an insulative tube-shaped nozzle of the shooting device.

The above and other objects, features and advantages of the present invention will become apparent from the following detailed description taken with the accompanying drawings.

DETAILED DESCRIPTION OF THE INVENTION

Figure 1:
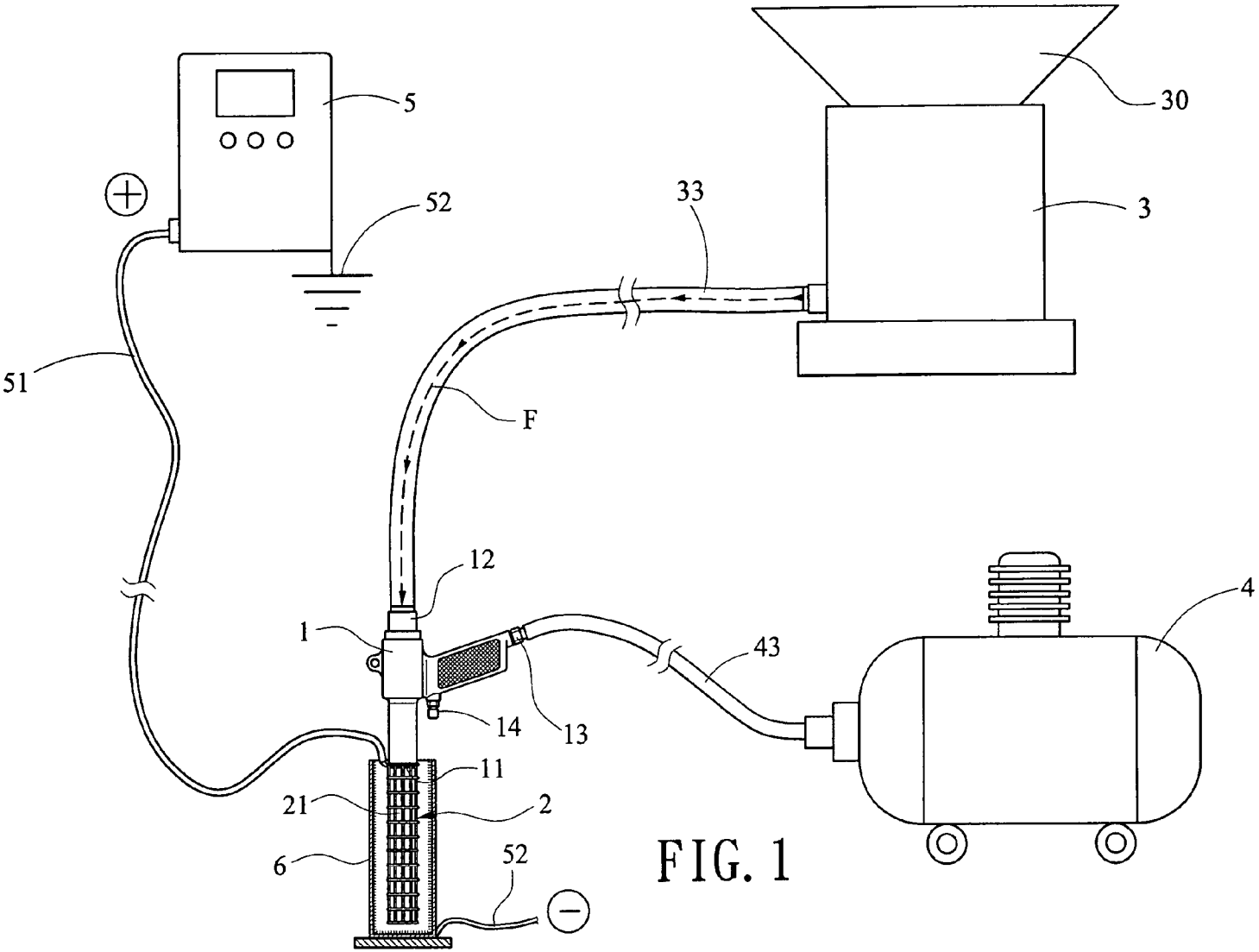
FIG. 1 schematically depicts a first preferred embodiment of apparatus for three-dimensionally planting pile according to the invention.
Figures 2A, 2B, 2C, 2D, 2E:
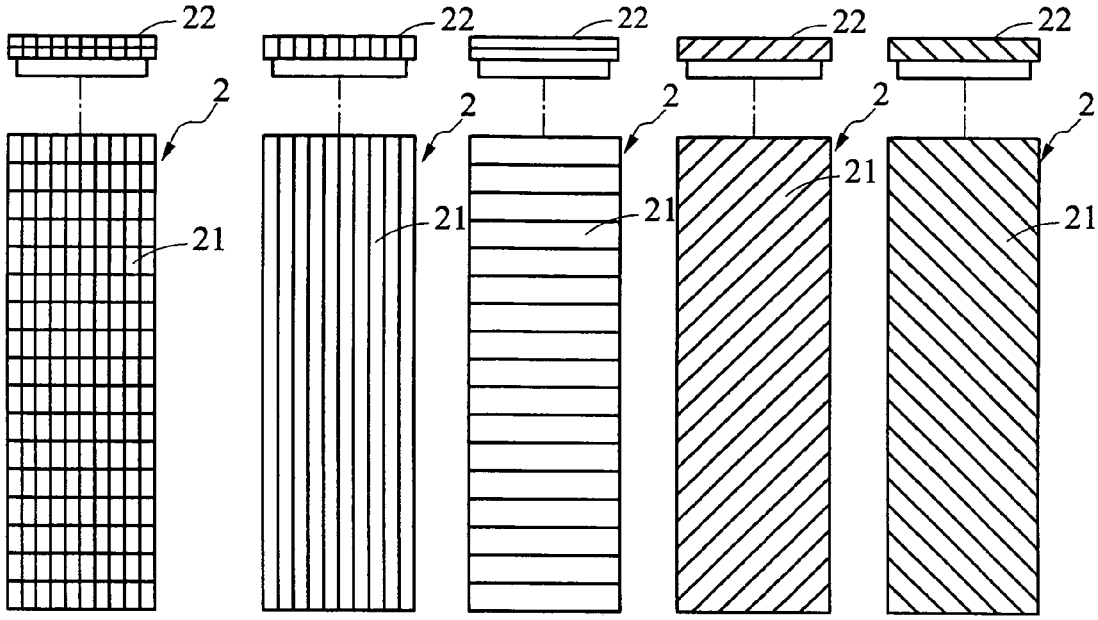
FIGS. 2A to 2I are plan views schematically showing a variety of planting devices.
Figures 2F, 2G, 2H, 2I:
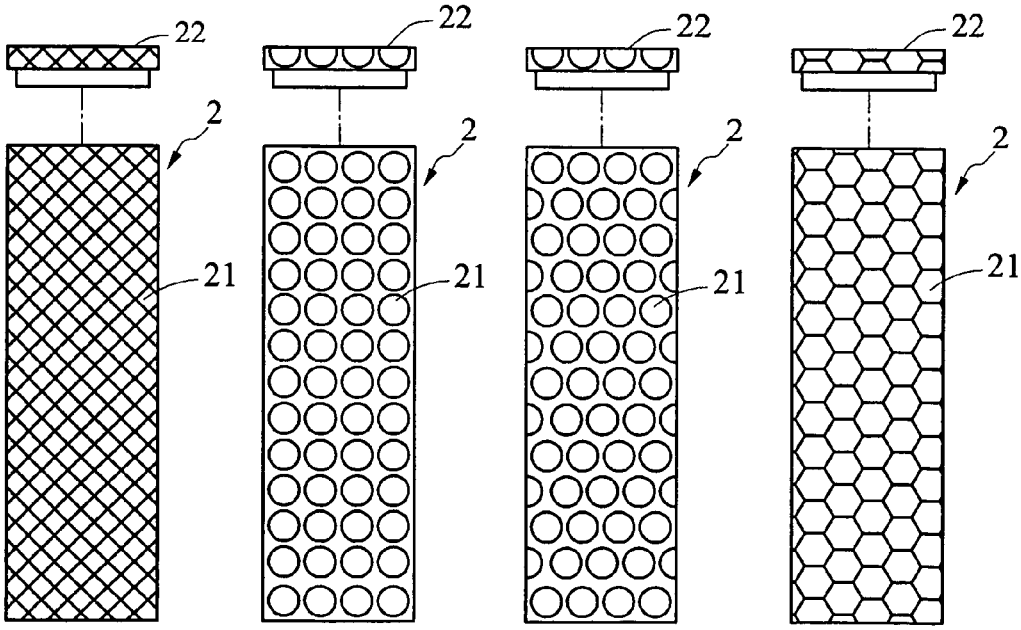

Referring to FIGS. 1 and 2, an apparatus for three-dimensionally planting pile in accordance with a first preferred embodiment of the invention comprises a shooting device (e.g., spray gun) 1 including a front nozzle 11, a rear inlet 12, a drive inlet 13, and a control member 14; and a hollow, cylindrical planting device 2 mounted at the nozzle 11 and including a peripheral mesh section 21 and a forward mesh section 22 in which the peripheral mesh section 21 has a plurality of rectangular openings (see FIG. 2A), a plurality of parallel longitudinal openings (see FIG. 2B), a plurality of parallel transverse openings (see FIG. 2C), a plurality of parallel oblique openings (see FIG. 2D), a plurality of parallel oblique openings perpendicular to that shown in FIG. 2D (see FIG. 2E), a plurality of openings formed by intersections of a first plurality of parallel oblique lines and a second plurality of parallel oblique lines perpendicular to the first plurality of parallel lines (see FIG. 2F), a plurality of circular openings (see FIGS. 2G and 2H), or a plurality of parallel hexagonal openings (see FIG. 2I). The forward mesh section 22 also has a plurality of openings each being shaped the same but smaller than that shown in the corresponding peripheral mesh section 21 of the same figure. Such configuration can prevent most pile from throwing out of the forward mesh section 22. That is, most pile leaves the planting device 2 from the peripheral mesh section 21 with only a small amount of pile leaving the planting device 2 from the forward mesh section 22.

Figure 1A:
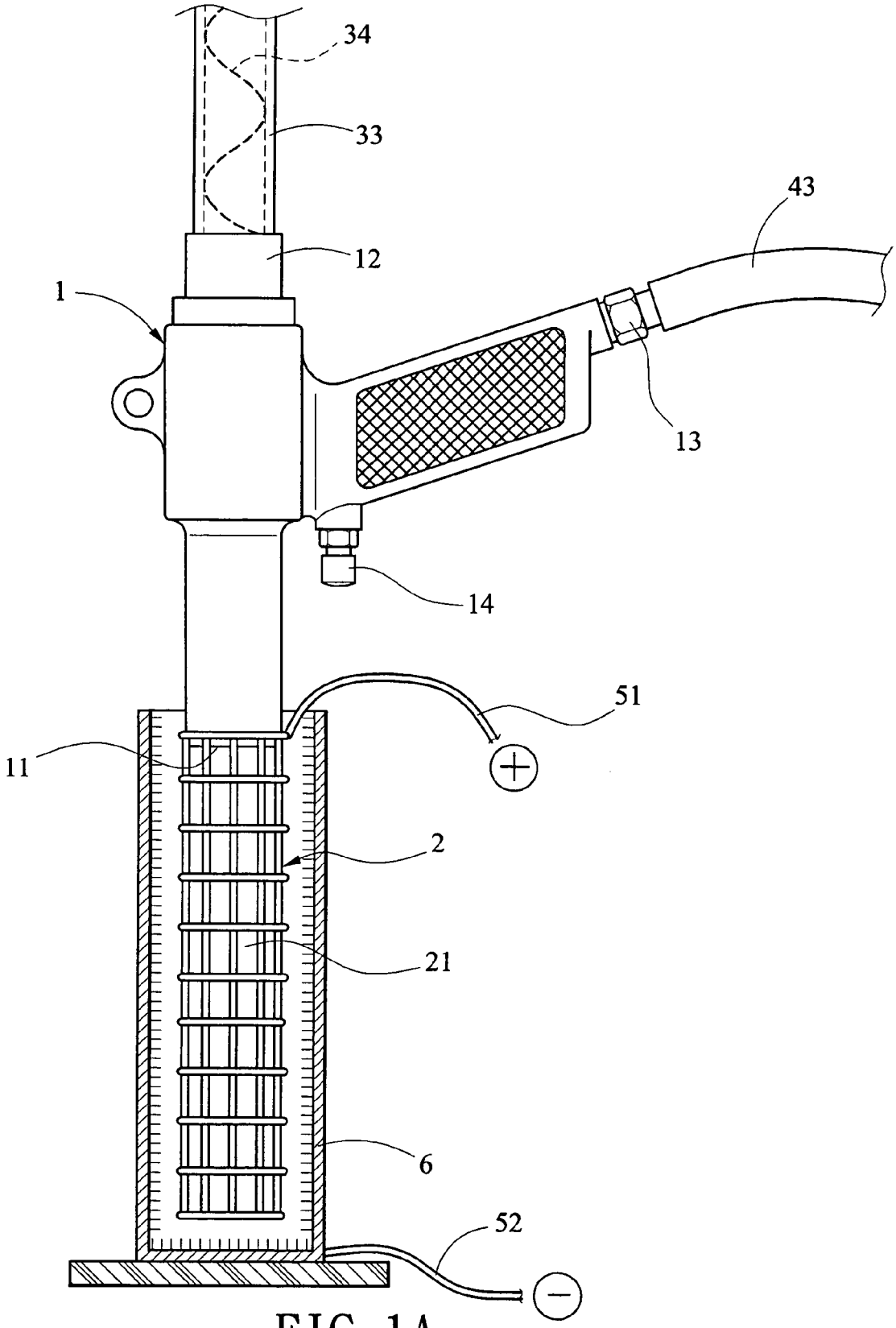
FIG. 1A is an enlarged view of spray gun, planting device, and member to be planted with pile in FIG. 1.
Figure 1B:
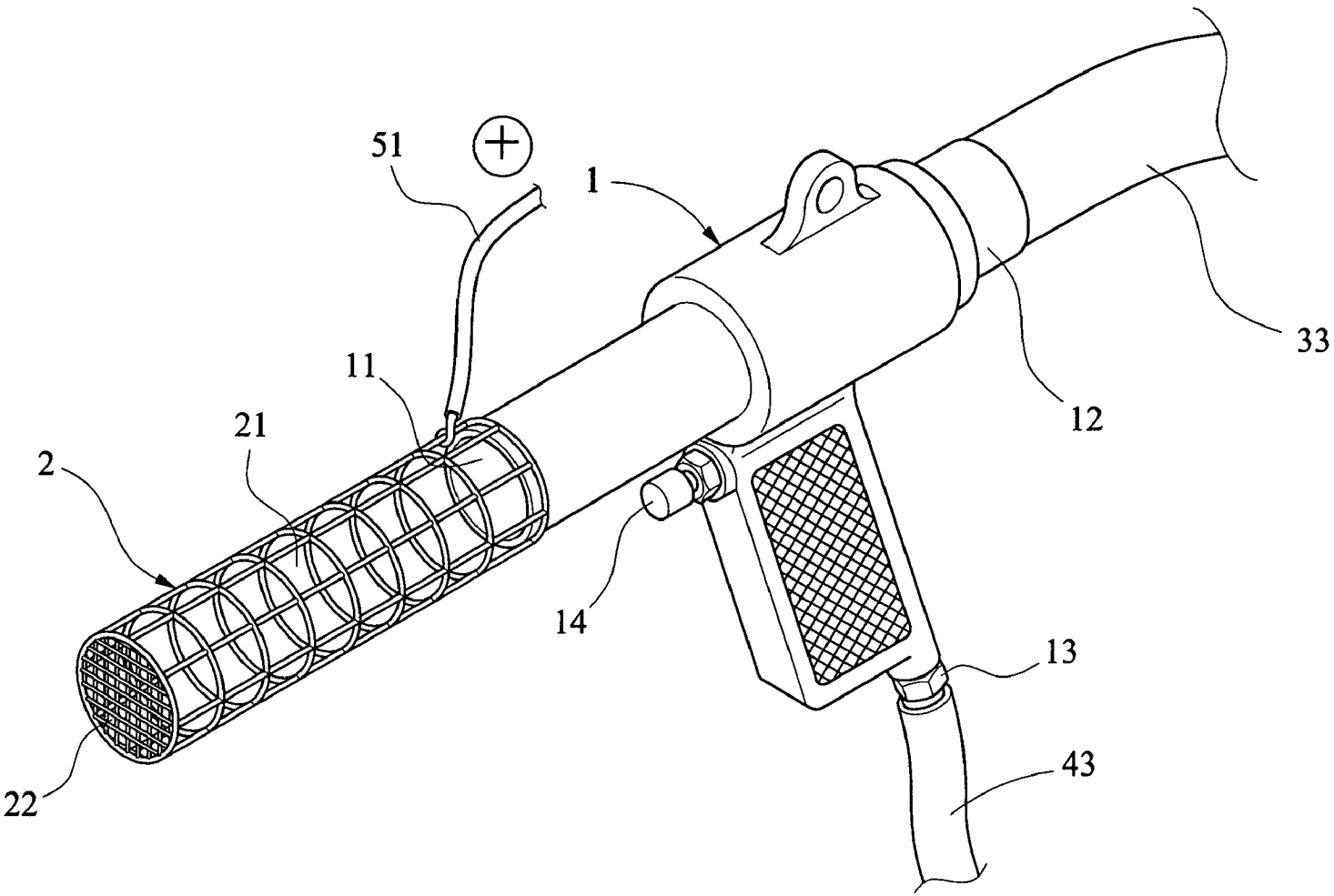
FIG. 1B is a perspective view of spray gun and planting device in FIG. 1.

The apparatus further comprises a pile feeding container 3 including a top pile inlet 30, a flexible pipe 33 interconnecting the pile feeding container 3 and the inlet 12, and spiral grooves 34 (see FIG. 1A) inside the pipe 33 for facilitating the conveying of pile; a drive source (e.g., air compressor) 4 connected to the drive inlet 13 and adapted to supply pressurized air to the spray gun 1 via the drive inlet 13; and a charge supply 5 including a positive charge supply terminal 51 electrically connected to the planting device 2 for forming a positive electric field thereon, and a negative charge supply terminal 52 electrically connected to a member 6 to be planted with pile for forming a negative electric field thereon. As a result, an electrostatic field from the planting device 2 to the member 6 is established. Also, the member 6 is a three-dimensional one and has its one or more surfaces coated with adhesive. Thus, pile is projected from the planting device 2 due to the driving of the electrostatic field and pile is then adhered to one or more surfaces of the member 6 after reaching it. Finally, a pile planting operation is finished. Note that the control member 14 is implemented as a trigger (as shown) or push button in another embodiment and is adapted to control on/off of both the pile feeding container 3 and the drive source 4.

Figure 3:
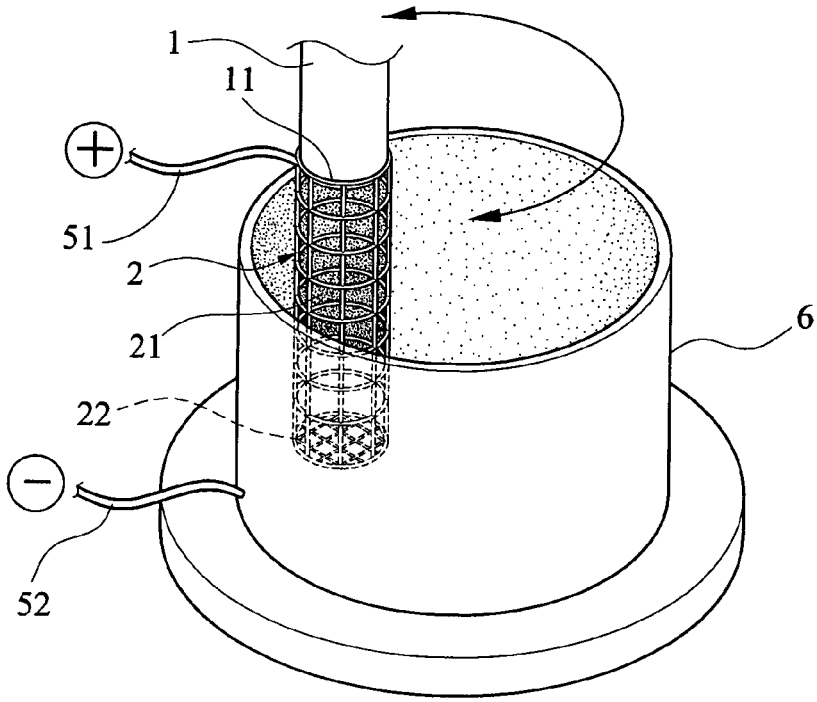
FIG. 3 is a perspective view showing one pile planting operation according to a second preferred embodiment of the invention.
Figure 4:
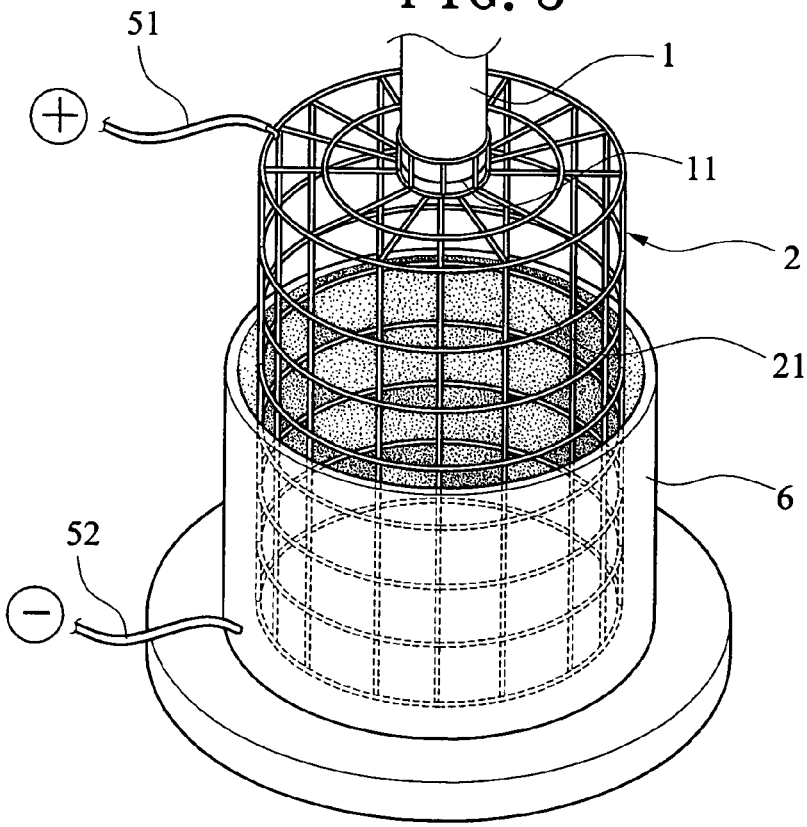
FIG. 4 is a perspective view showing another pile planting operation according to the second preferred embodiment of the invention.

Referring to FIGS. 3 and 4, two pile planting operations according to a second preferred embodiment of the invention are illustrated. Either operation involves coating adhesive on one or more surfaces of the three-dimensional member 6; electrically connecting the positive charge supply terminal 51 to the planting device 2 for forming a positive electric field thereon; electrically connecting the negative charge supply terminal 52 to the member 6 for forming a negative electric field thereon and thus establishing an electrostatic field from the planting device 2 to the member 6; activating the spray gun 1 to project pile from the planting device 2 toward the surfaces of the member 6 in high speed as driven by the electrostatic field and pressurized air fed from the drive source 4; and causing the pile to adhere to the surfaces of the member 6 after reaching it. A movement of the planting device 2 relative to the member 6 or not is determined by shape and size of the planting device 2. For example, the planting device 2 may rotate around an inner surface of the member 6 if the planting device 2 has a size much smaller than that of the member 6 (see FIG. 3). Alternatively, the planting device 2 may not rotate relative to the member 6 (i.e., stationary) if most internal space of the member 6 is occupied by the planting device 2 (see FIG. 4). Either configuration aims at providing an optimum pile planting effect.

Figure 5:
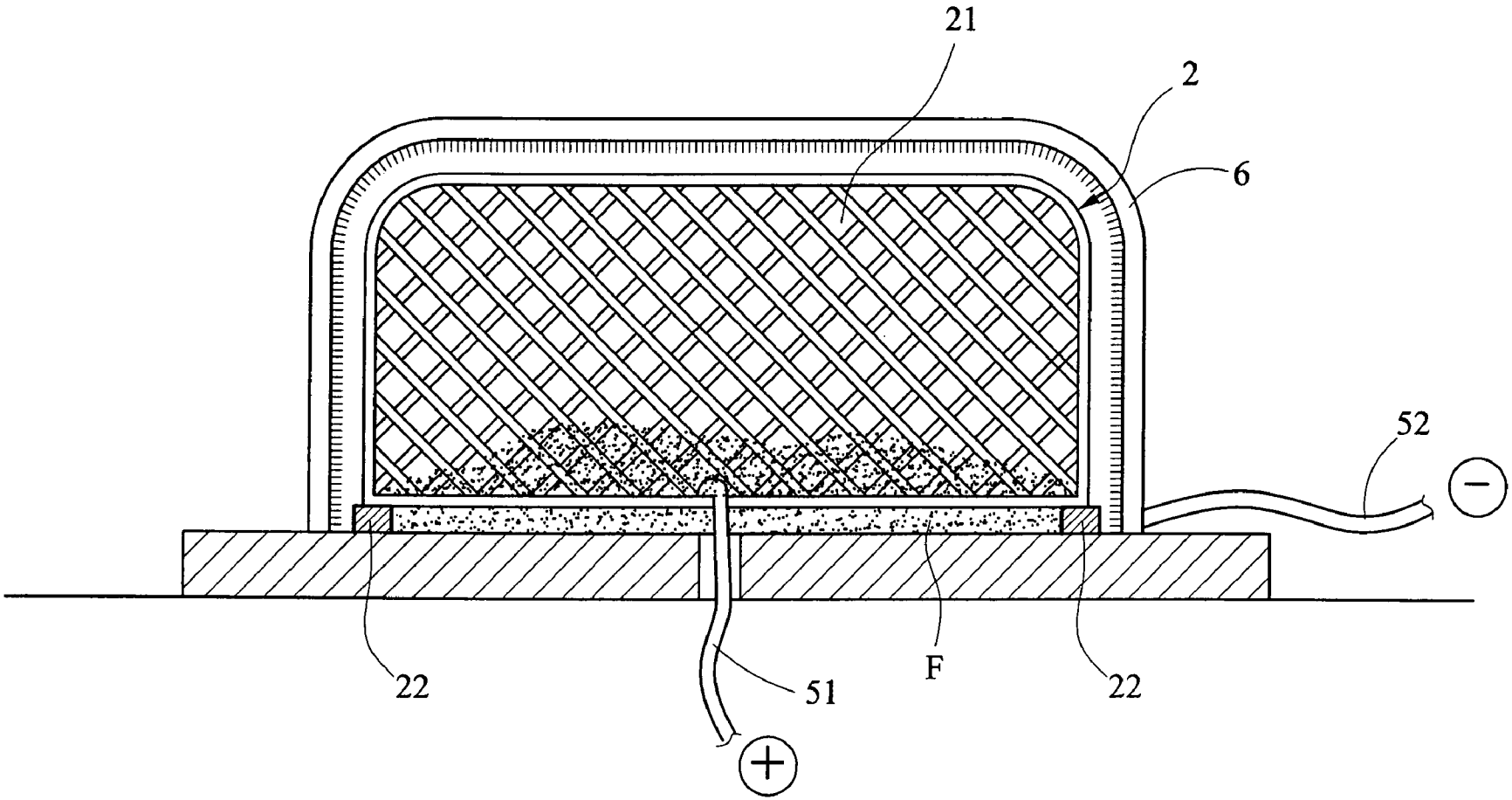
FIG. 5 is a perspective view showing a pile planting operation according to a third preferred embodiment of the invention.

Referring to FIG. 5, a pile planting operation according to a third preferred embodiment of the invention is illustrated. The third preferred embodiment substantially has same structure as the second preferred embodiment. The characteristics of the third preferred embodiment are detailed below. The spray gun 1 is eliminated. The peripheral mesh section 21 occupies most internal space of the member 6. An insulative ring pad 22 is provided on bottom of the planting device 2. A central hole is formed on a bed with the positive charge supply terminal 51 passed through. The positive planting device 2 is electrically insulated from the negative member 6. Pile F is filled in the planting device 2 on top of the bed. Pile F may uniformly adhere to the inner surfaces of the member 6 in response to establishing an electrostatic field from the planting device 2 to the member 6 (i.e., activation of the charge supply 5).

Figure 5A:
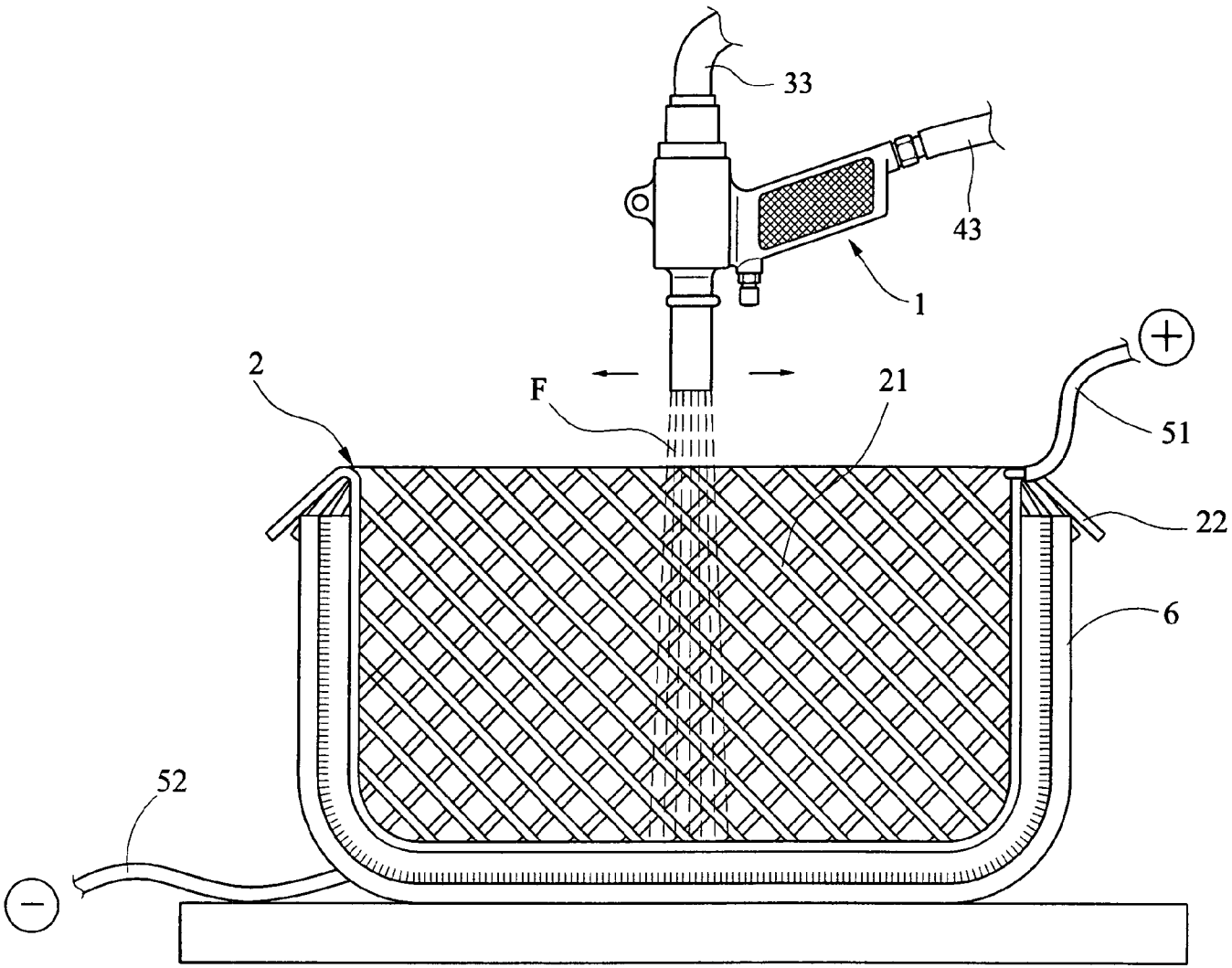
FIG. 5A schematically depicts another configuration of the third preferred embodiment shown in FIG. 5A.

Referring to FIG. 5A, another configuration of the third preferred embodiment is shown. Another configuration substantially has same structure as the third preferred embodiment shown in FIG. 5 with certain exceptions. A spray gun 1 is provided above the member 6. The planting device 2 is disposed in the member 6. A peripheral lip 22 of the planting device 2 is rested upon edge of the member 6 for anchoring the planting device 2. In a pile planting operation, a person may move the spray gun 1 to spray pile onto inner surface of the member 6.

Figure 6:
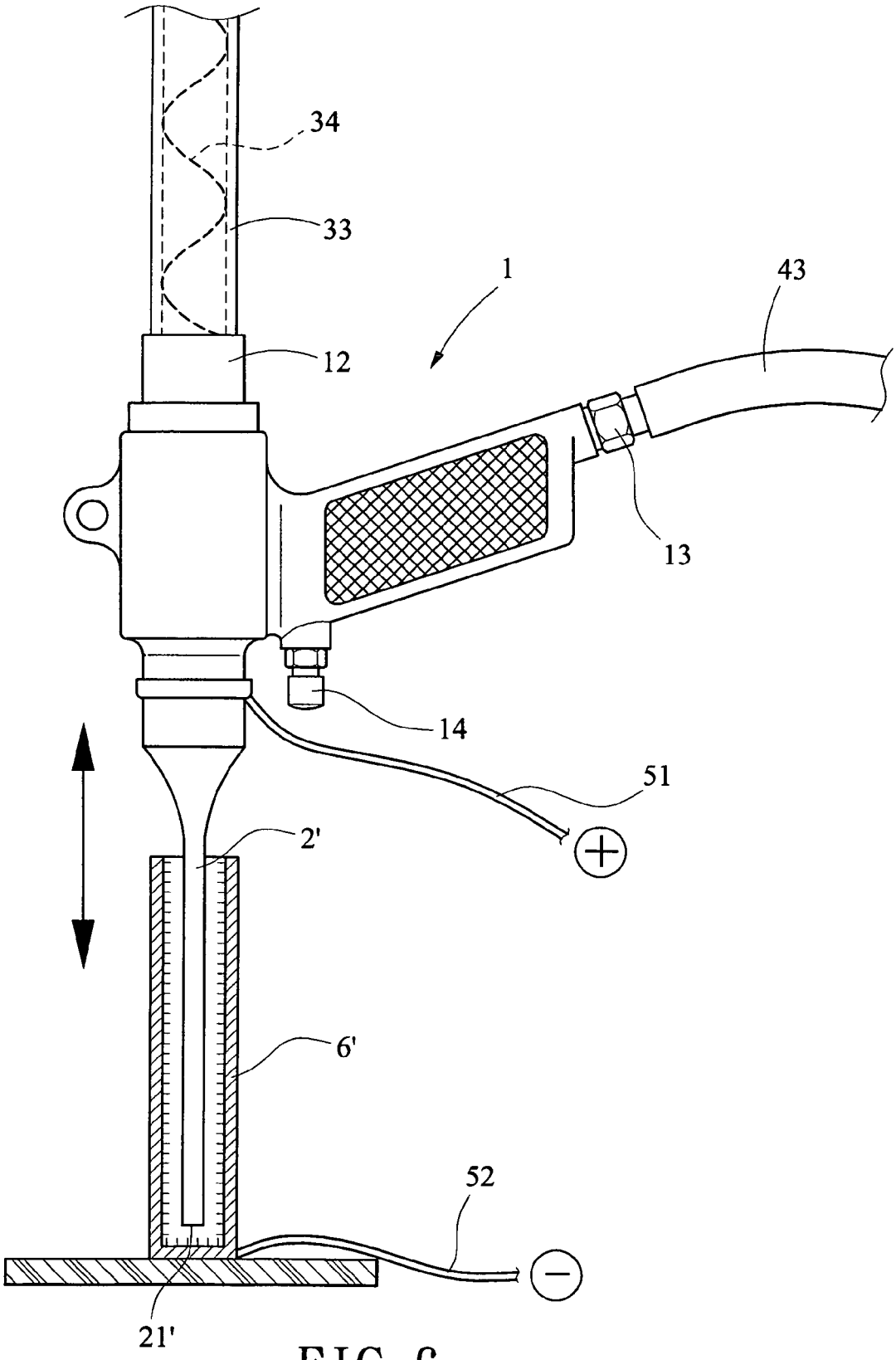
FIG. 6 is a view similar to FIG. 1A showing spray gun, planting device, and member to be planted with pile according to a fourth preferred embodiment of the invention and a pile planting operation thereof.

Referring to FIG. 6, it shows major components including spray gun, planting device, and member to be planted with pile according to a fourth preferred embodiment of the invention and a pile planting operation thereof is illustrated. The fourth preferred embodiment substantially has same structure as the first preferred embodiment. The characteristics of the fourth preferred embodiment are detailed below. An elongate tube 2' has a flared end secured to a forward mouth of the spray gun 1. The elongate tube 2' is adapted to insert into inside of an elongate member 6' to be planted with pile. The tube 2' is adapted to move into the member 6' and leave same in one of a plurality of continuous cycles (i.e., reciprocative) so as to uniformly adhere pile to the inner surface of the member 6'.

Preferably, a nozzle 21' of the tube 2' has a diameter in the range of about 1 mm to 3 mm. Also, the opening 21' may have a section of circle, square, rectangle, or the like. The pile planting operation involves coating adhesive on the inner surface of the three-dimensional member 6'; electrically connecting the positive charge supply terminal 51 to the tube 2' for forming a positive electric field thereon; electrically connecting the negative charge supply terminal 52 to the member 6' for forming a negative electric field thereon and thus establishing an electrostatic field from the tube 2' to the member 6'; activating the spray gun 1 to project pile from the tube 2' toward the inner surface of the member 6' in high speed as driven by the electrostatic field and pressurized air fed from the drive source 4 as the tube 2' moved into the member 6' and left same alternately; and causing the pile to adhere to the surface of the member 6' after reaching it.

Figure 7:
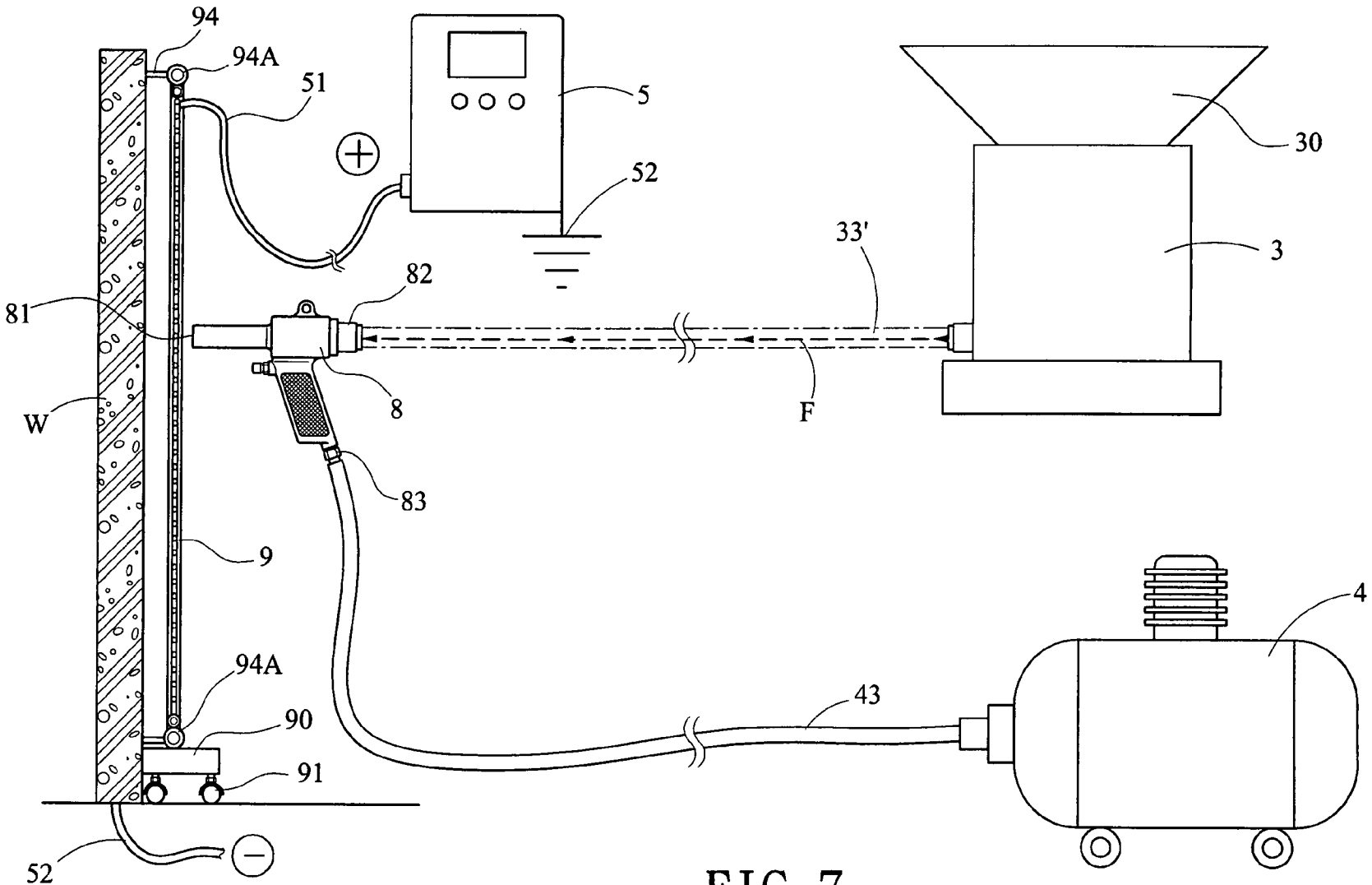
FIG. 7 schematically depicts a fifth preferred embodiment of apparatus for three-dimensionally planting pile according to the invention.
Figure 8:
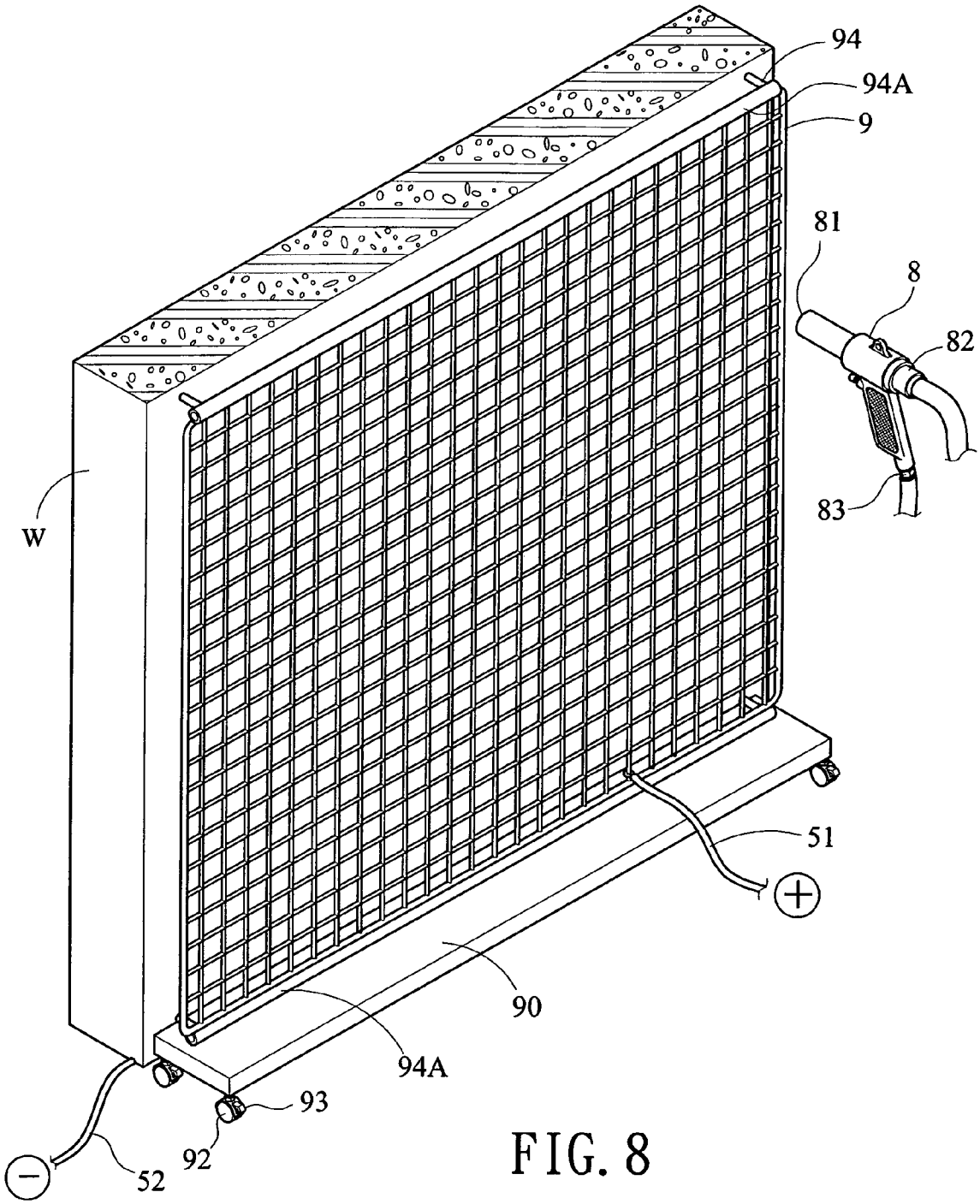
FIG. 8 is a perspective view of spray gun and planting device in FIG. 7.

Referring to FIGS. 7 and 8, a fifth preferred embodiment of apparatus for three-dimensionally planting pile on a large area according to the invention is shown. The apparatus comprises the following components. A rectangular planting device 9 is provided upright in front of a member having a large area to be planted with pile (e.g., wall W). The planting device 9 is flat, substantially flat, or curved and is formed of metal meshes. The planting device 9 comprises a lower rectangular platform 90 having four wheels 91 on four corners and a brake 93 at each of the wheels 91 (i.e., the planting device 9 is thus movable), and top and bottom U-shaped insulative members 94 each having both ends engaged with the wall W and a transverse member 94A provided on top or bottom of the planting device 9 in which the transverse member 94A of the bottom insulative member 94 is rested upon the platform 90. A spray gun 8 includes a front nozzle 81, a rear inlet 82, and a drive inlet 83. A pile feeding container 3 includes a top pile inlet 30, and a flexible pipe 33' interconnecting the pile feeding container 3 and the inlet 82. A drive source (e.g., air compressor) 4 is connected to the drive inlet 83 and is adapted to supply pressurized air to the spray gun 8 via the drive inlet 83. A charge supply 5 includes a positive charge supply terminal 51 electrically connected to the planting device 9 for forming a positive electric field thereon, and a negative charge supply terminal 52 electrically connected to the wall W for forming a negative electric field thereon. As a result, an electrostatic field from the planting device 9 to the wall W is established. In response to activating the spray gun 8, the drive source 4, and the charge supply 5, pile is projected from the spray gun 8 due to the driving of the electrostatic field and pile is then adhered to the surface of the wall W by passing the planting device 9. Preferably, a distance between the wall W and the planting device 9 is maintained in the range of about 3 cm to 10 cm for obtaining an optimum pile planting effect. Also, the planting device 9 may be shaped as one of the forms shown in FIGS. 2A to 21. Further, the member having a large area to be planted with pile may be a ceiling, floor, or the like other than wall W in other embodiments.

Figure 9:
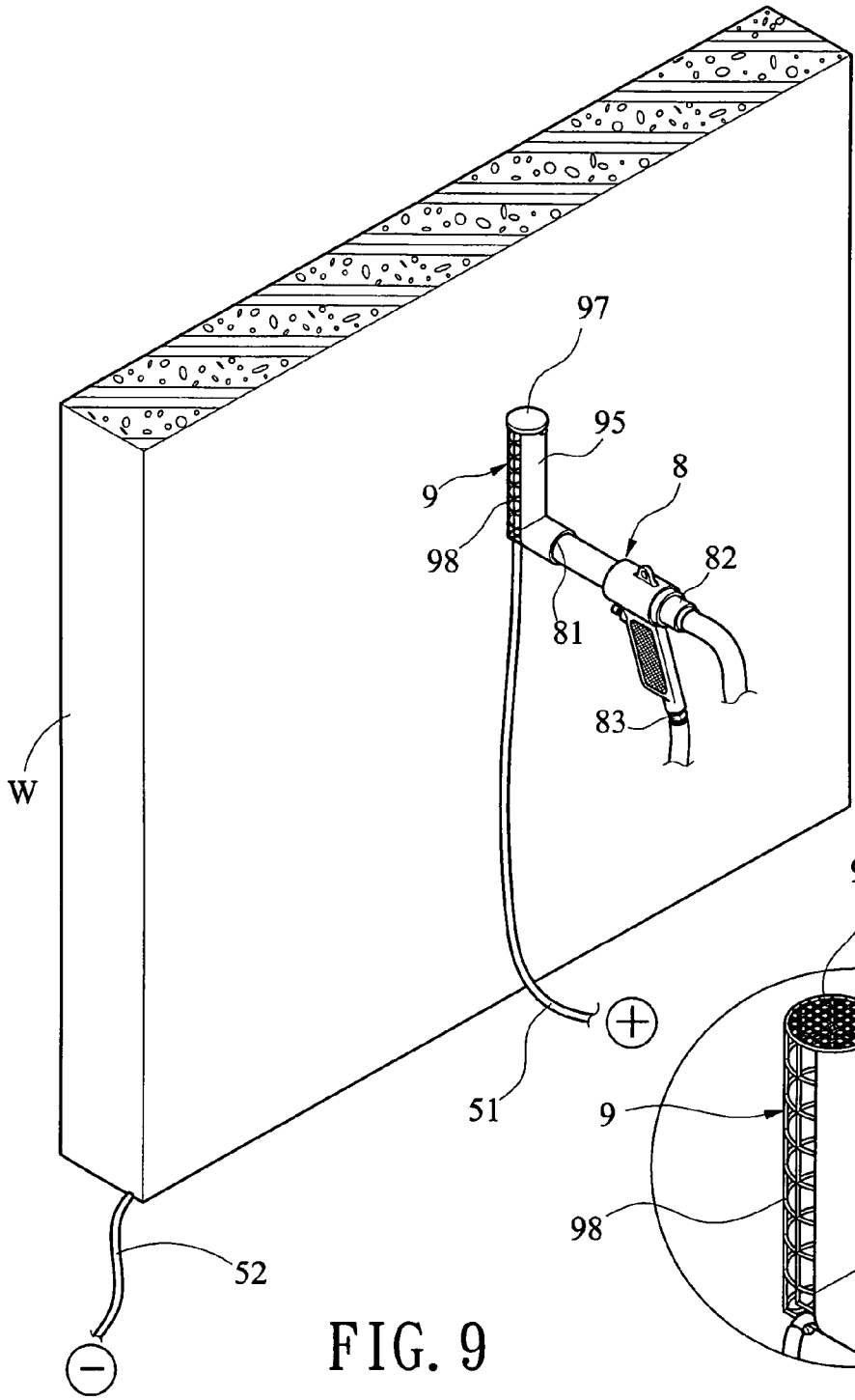
FIG. 9 is a perspective view showing spray gun, planting device, and member to be planted with pile configured according to a sixth preferred embodiment of the invention.
Figure 9A:
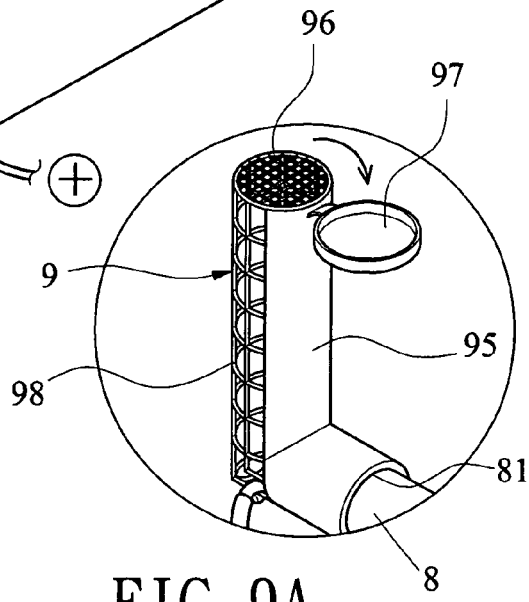
FIG. 9A is a detailed view of the planting device in FIG. 9.
Figure 10:
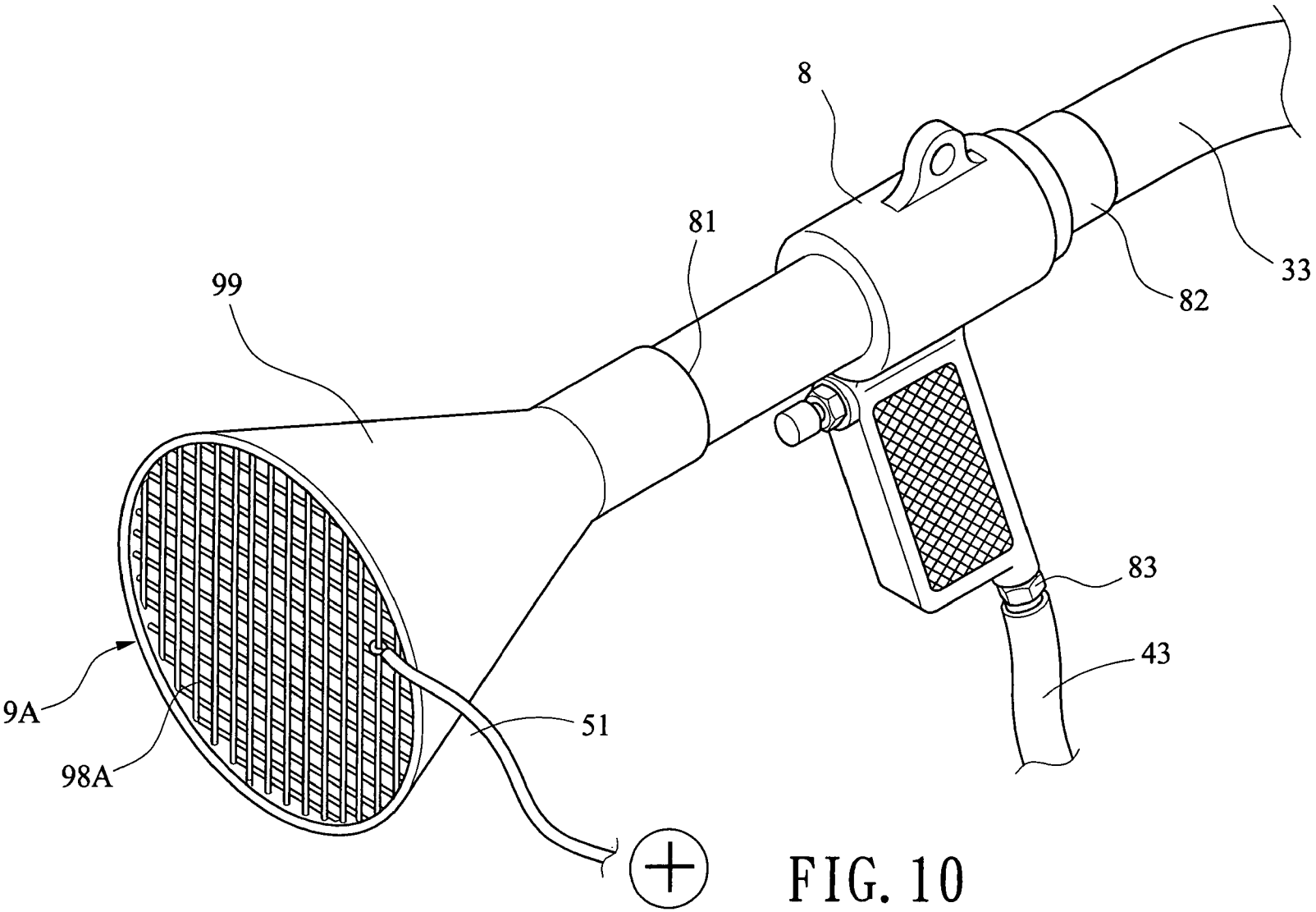
FIG. 10 is a perspective view showing the assembly of spray gun and a different planting device according to the sixth preferred embodiment of the invention.

Referring to FIGS. 9, 9A, and 10, a sixth preferred embodiment of the invention for three-dimensionally planting pile on a large area is shown. The sixth preferred embodiment substantially has same structure as the fifth preferred embodiment. The characteristics of the sixth preferred embodiment are detailed below. As shown in FIGS. 9 and 9A, the planting device 9 is shaped as an L-shaped cylinder and comprises an L-shaped member 95 having an open end secured to an insulative tube-shaped nozzle 81 of the spray gun 8, a mesh-like member 98 of curved section together with the upright portion of the member 95 forming a complete cylinder, a fine mesh member 96 provided at a top opening, and a hinged cap 97 provided at the top opening. The cap 97 is pivoted to close the top opening in pile planting operation for preventing pile from leaving the planting device 9 through the top opening. The cap 97 is open after the pile planting operation such that a fine modification of the pile planted on a member can be made through the mesh member 96. The positive charge supply terminal 51 of the charge supply 5 is electrically connected to a bent portion of the planting device 9 for establishing a positive electric field thereon. Also, the negative charge supply terminal 52 thereof is electrically connected to the member W for establishing a negative electric field thereon. As a result, an electrostatic field from the planting device 9 to the member W is established.

As shown in FIG. 10, another planting device 9 shaped as a horn is provided. The planting device 9A comprises a narrow tube secured to the tube-shaped nozzle 81 of the spray gun 8 and a flared portion 99 having metal meshes on its mouth and which is electrically connected to the positive charge supply terminal 51.

The pile planting operation involves coating adhesive on the surface of the member W; electrically connecting the positive charge supply terminal 51 to the planting device 9A for forming a positive electric field thereon; electrically connecting the negative charge supply terminal 52 to the member W for forming a negative electric field thereon and thus establishing an electrostatic field from the planting device 9A to the member W activating the spray gun 8 to project pile from the planting device 9A toward the surface of the member Win high speed as driven by the electrostatic field and pressurized air fed from the drive source (not shown); and causing the pile to adhere to the surface of the member W after reaching it.

Figure 11:
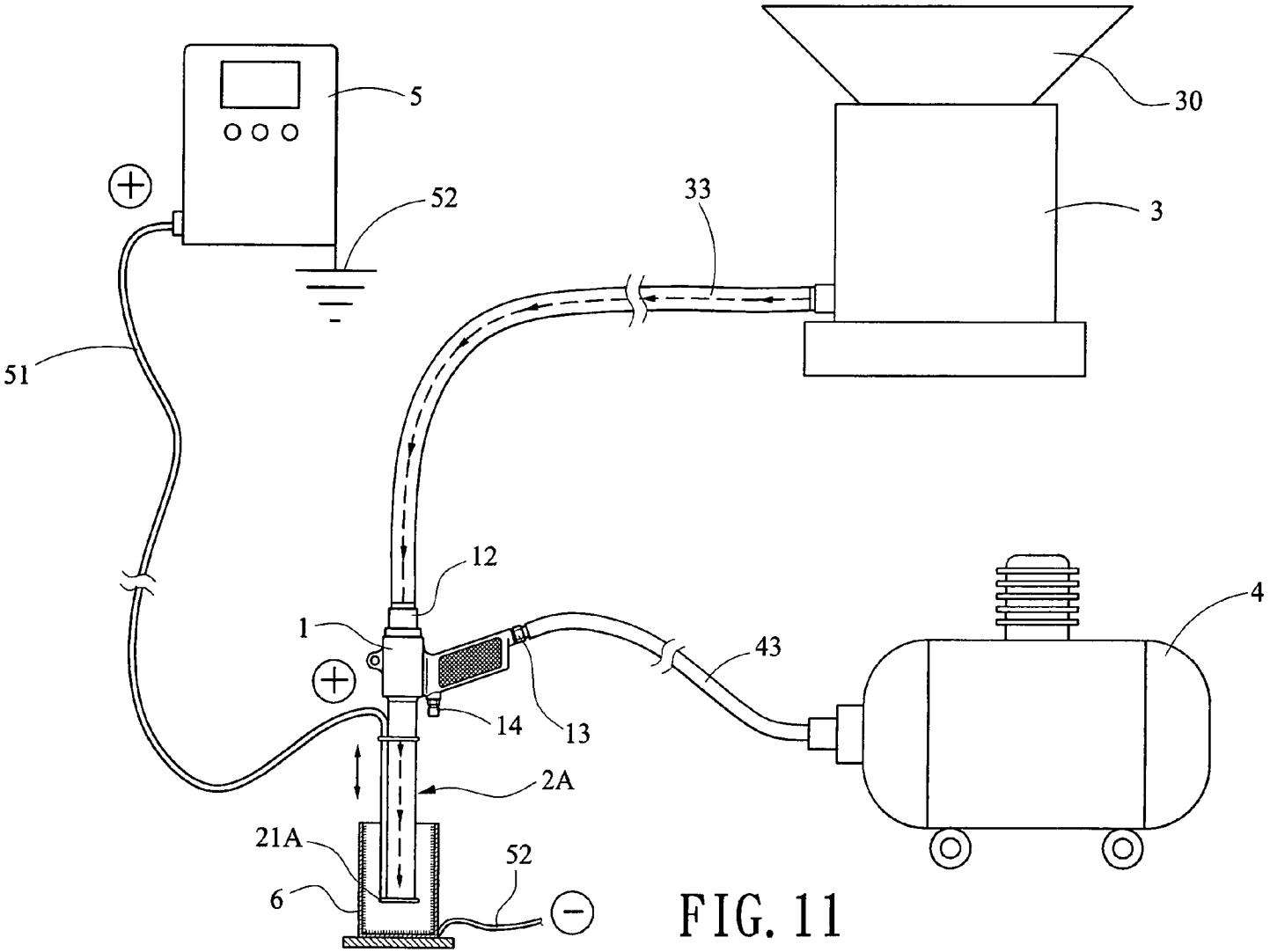
FIG. 11 schematically depicts a seventh preferred embodiment of apparatus for three-dimensionally planting pile according to the invention.

Referring to FIG. 11, a seventh preferred embodiment of the invention for three-dimensionally planting pile is shown. The seventh preferred embodiment substantially has same structure as the first preferred embodiment. The characteristics of the seventh preferred embodiment are detailed below. As shown in FIG. 11, The mesh section of the planting device 2A is eliminated and replaced with a metal ring member 21A mounted on the front nozzle. The remaining components are all same as the first embodiment and thus the related descriptions are omitted.

Figure 12:
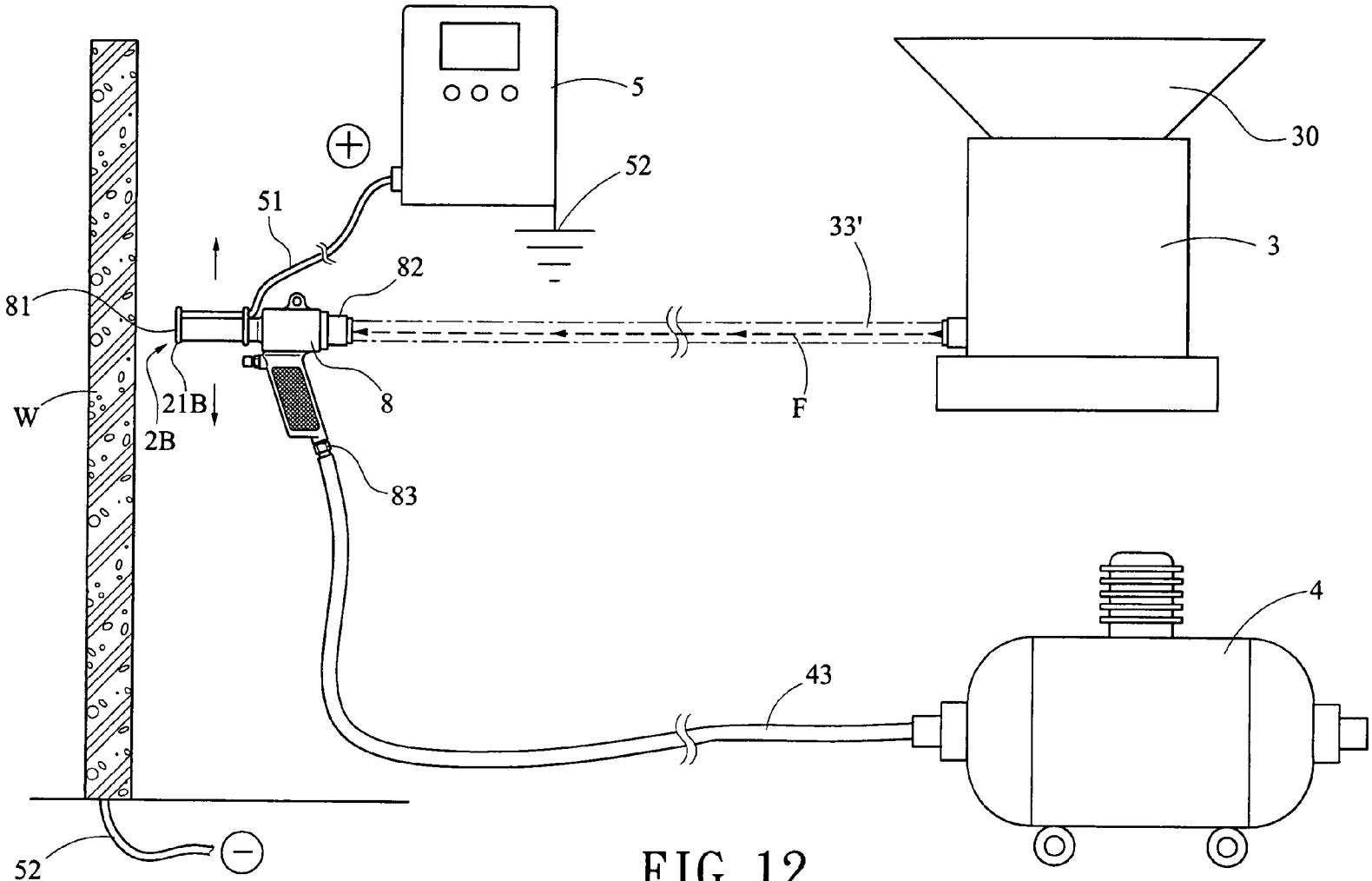
FIG. 12 schematically depicts a eighth preferred embodiment of apparatus for three-dimensionally planting pile according to the invention.

Referring to FIG. 12, a eighth preferred embodiment of the invention for three-dimensionally planting pile is shown. The eighth preferred embodiment substantially has same structure as the fifth preferred embodiment. The characteristics of the eighth preferred embodiment are detailed below. As shown in FIG. 12, The metal mesh of the planting device 2B is eliminated and replaced with a metal ring member 21B mounted on the front nozzle 81. The remaining components are all same as the fifth embodiment and thus the related descriptions are omitted.

Figure 13:
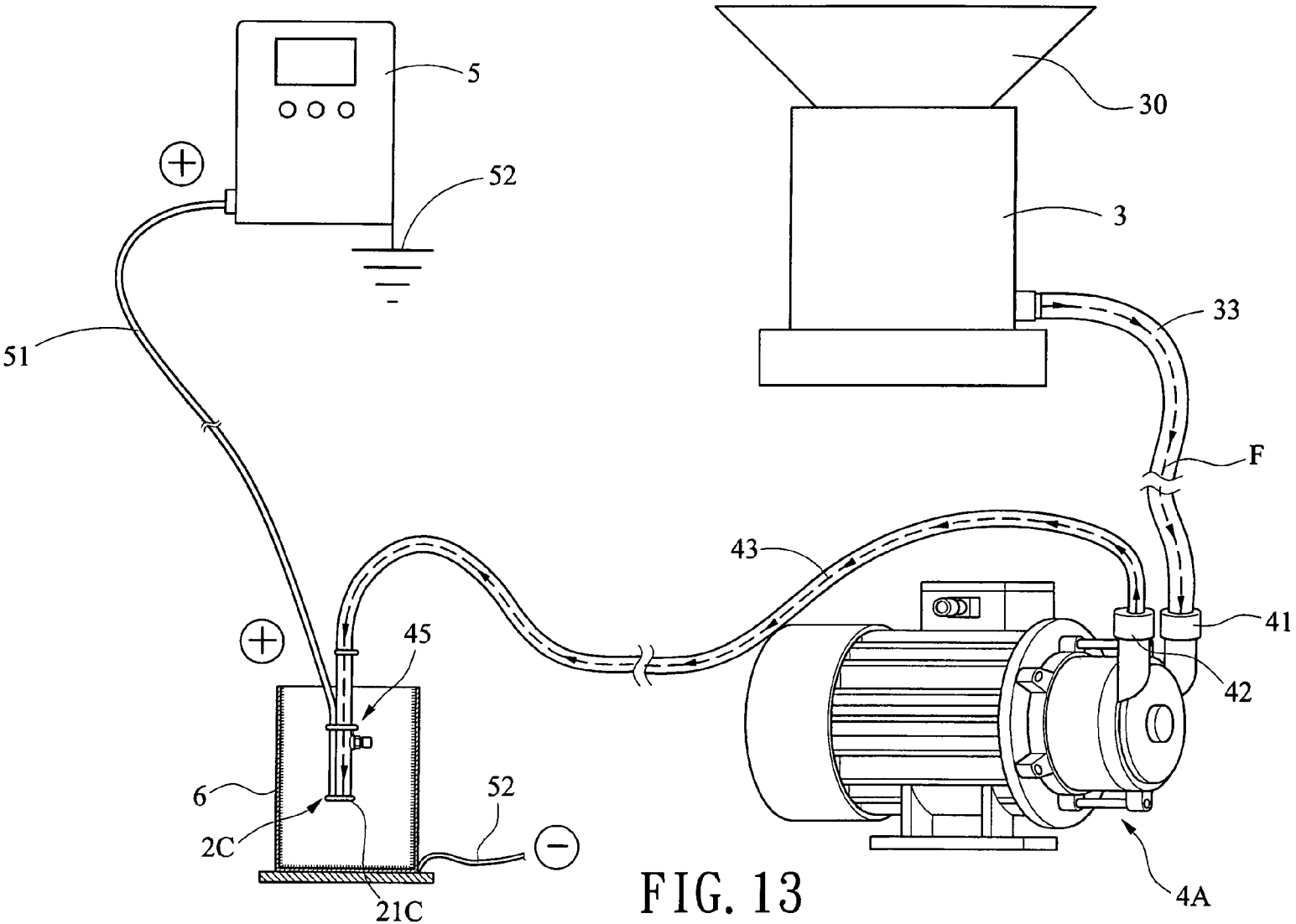
FIG. 13 schematically depicts a ninth preferred embodiment of apparatus for three-dimensionally planting pile according to the invention.

Referring to FIG. 13, a ninth preferred embodiment of the invention for three-dimensionally planting pile is shown. The ninth preferred embodiment substantially has same structure as the first preferred embodiment. The characteristics of the seventh preferred embodiment are detailed below. As shown in FIG. 13, the drive source now is replaced with a vacuum pumping device 4A. The vacuum pumping device 4A has a suction port 41 in communicated with the pile feeding container 3 through the flexible pipe 33, a discharging port 42 connected to a metal ring member 21C of the planting device 2 (which is also electrically connector to the positive charge supply terminal 51) through the flexible pipe 43 and a power switch (not shown) to control the power supply of the vacuum pumping device 4A, thus the shooting device 1 in this embodiment is therefore omitted. In this way, the vacuum pumping device 4A can also perform with the same function as the air compressor 4 mentioned in the first embodiment. The remaining components are all same as the first embodiment and the related descriptions are hereby omitted.

The pile according to the present invention may be nylon, polyester (e.g., artificial fiber pile), cotton, wool (e.g., natural fiber pile), mineral substance or the like. Preferably, the opening of the planting device 2 or the planting device 9 has a size larger than a length of pile.

While the invention herein disclosed has been described by means of specific embodiments, numerous modifications and variations could be made thereto by those skilled in the art without departing from the scope and spirit of the invention set forth in the claims.

What is claimed is:

1. An apparatus for three-dimensionally planting pile comprising:

a shooting device;

a planting device mounted at the shooting device wherein the planting device is a metal mesh cylinder including a forward mesh section and a peripheral mesh section connected with the forward mesh section, a rear of the peripheral mesh section being engaged with a front of the shooting device;

a pile-feeding container in pile communication with the shooting device through a flexible pipe for supplying pile;

a drive source for feeding pressurized air to the shooting device; and a charge supply for supplying charges to the planting device and a member to be planted with pile, respectively so as to establish an electrostatic field from the planting device to the member, applying the electrostatic field on the pile, and projecting the pile toward an inner surface of the member through the mesh sections of the cylinder;

wherein the shooting device is a spray gun and the drive source is an air compressor or vacuum pumping device.

2. The apparatus of claim 1, wherein the shooting device comprises a front nozzle with the planting device mounted thereat, a rear inlet in pile communication with the shooting device through the flexible pipe, a drive inlet in pressurized air communication with the drive source, and a control member adapted to control on/off of both the pile feeding container and the drive source.

3. The apparatus of claim 1, wherein the planting device is a metal ring member.

4. The apparatus of claim 1, wherein the flexible pipe interconnecting the shooting device and the pile feeding container has spiral grooves on its inner surface.

5. The apparatus of claim 1, wherein the member further comprises three-dimensional inner surface for being vertically planted pile thereon.

6. The apparatus of claim 1, wherein the forward mesh section has a plurality of openings each being smaller than that of the peripheral mesh section.

* * * * *